US006502553B2

(12) United States Patent
Banzhaf

(10) Patent No.: US 6,502,553 B2
(45) Date of Patent: Jan. 7, 2003

(54) SOLENOID VALVE FOR REGULATING THE FUEL SUPPLY PRESSURE OF AN INTERNAL COMBUSTION ENGINE

(75) Inventor: Werner Banzhaf, Sindelfingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/784,795

(22) Filed: Feb. 15, 2001

(65) Prior Publication Data

US 2001/0029930 A1 Oct. 18, 2001

(30) Foreign Application Priority Data

Feb. 15, 2000 (IT) ..... T0000A0143

(51) Int. Cl.[7] ..... F02M 41/00
(52) U.S. Cl. ..... 123/458; 123/499
(58) Field of Search ..... 123/458, 499; 251/129.15, 129.1; 137/549, 550; 210/407, 456

(56) References Cited

U.S. PATENT DOCUMENTS

| | | | | |
|---|---|---|---|---|
| 3,958,902 A | * | 5/1976 | Toyoda et al. | 417/279 |
| 4,262,877 A | * | 4/1981 | Lang | 251/141 |
| 4,981,155 A | * | 1/1991 | Pick et al. | 137/238 |
| 5,626,121 A | * | 5/1997 | Kushida et al. | 123/514 |
| 6,283,390 B1 | * | 9/2001 | Brendle et al. | 239/533.2 |

* cited by examiner

*Primary Examiner*—Willis R. Wolfe
*Assistant Examiner*—Mahmoud Gimie
(74) *Attorney, Agent, or Firm*—Merchant & Gould P.C.

(57) ABSTRACT

The solenoid valve has a fuel supply conduit, and a ball shutter controlled by an electromagnet and cooperating with a conical seat in the conduit. The conduit has fuel filtration means having a cylindrical wall with a number of openings for preventing particles of dirt from infiltrating between the seat and the shutter, without producing an excessive fall in fuel pressure. The thickness of the cylindrical wall is less than 1 mm, and the width of the openings is less than 0.25 mm.

11 Claims, 2 Drawing Sheets

SOLENOID VALVE FOR REGULATING THE FUEL SUPPLY PRESSURE OF AN INTERNAL COMBUSTION ENGINE

The present invention relates to an improved solenoid valve for regulating the fuel supply pressure of an internal combustion engine.

BACKGROUND OF THE INVENTION

In modern engine fuel supply systems, a high-pressure pump feeds the fuel to a distributor or so-called "common rail", which supplies the various engine cylinder injectors; and a solenoid valve controlled by a pressure sensor is normally provided to control and keep the fuel pressure in the distributor constant and to drain into the tank any surplus fuel supplied by the high-pressure pump. The solenoid valve comprises a supply conduit communicating with the delivery conduit of the high-pressure pump; and a shutter controlled by an electromagnet and cooperating with a seat in the supply conduit.

In one known pressure regulating solenoid valve incorporated in a radial-piston pump, the shutter is defined by a ball controlled by the end of a stem on the electromagnet armature and cooperating with a conical sealing seat at one end of the supply conduit.

On account of dirt, e.g. metal particles, settling between the ball and the conical sealing seat, the above solenoid valve is subject to sealing problems resulting in a fall in pressure and, hence, malfunctioning of the supply system as a whole. And, due to the extremely high operating pressure involved, e.g. in the region of 1400 bar, ordinary filtration means in the supply conduit likewise result in a fall in pressure along the supply conduit.

SUMMARY OF THE INVENTION

It is an object of the invention to provide a pressure regulating solenoid valve, which is extremely straightforward and reliable, and provides for eliminating the aforementioned drawbacks typically associated with known solenoid valves.

According to the present invention, there is provided a solenoid valve for regulating fuel supply pressure, and which comprises a fuel supply conduit, and a shutter controlled by an electromagnet and cooperating with a seat in said conduit, and is characterized by fuel filtration means located in said conduit and comprising a wall having a number of openings for preventing particles of dirt from infiltrating between said seat and said shutter, without producing an excessive fall in fuel pressure; the thickness of said wall being less than 1 mm; and the width of said openings being less than 0.25 mm.

BRIEF DESCRIPTION OF THE DRAWINGS

A number of preferred, non-limiting embodiments of the invention will be described by way of example with reference to the accompanying drawings, in which.

DETAILED DESCRIPTION OF THE INVENTION

Figure 1:
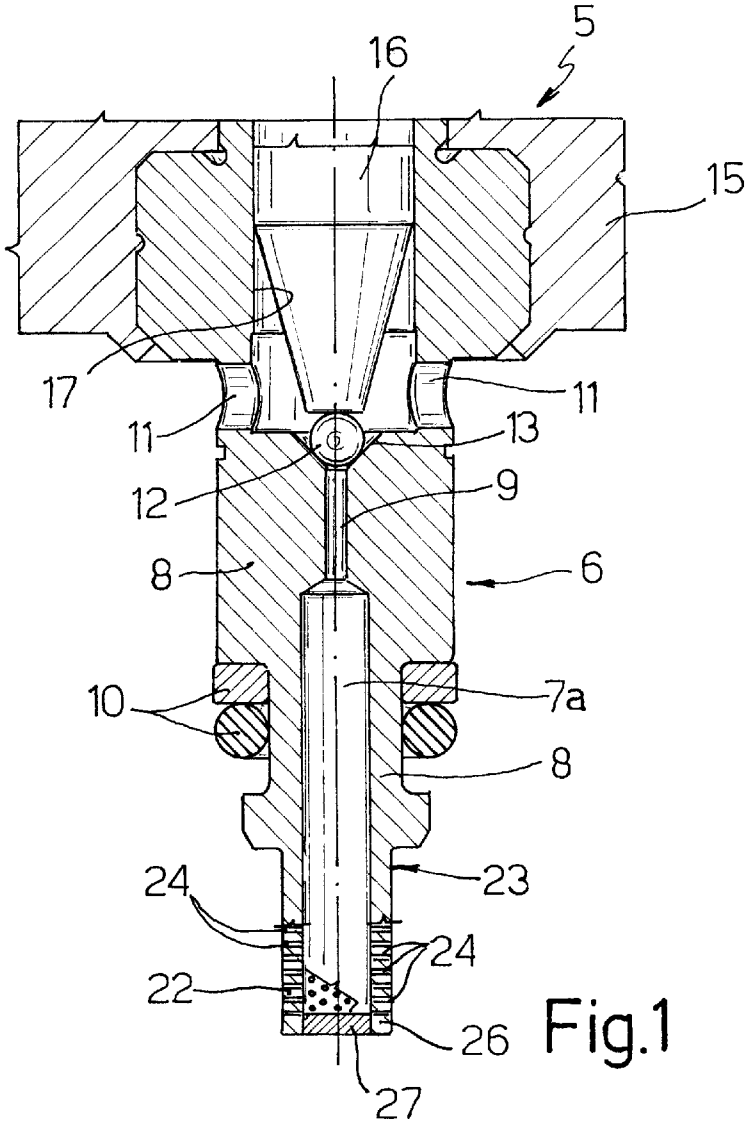
FIG. 1 shows a section of a first embodiment of a fuel pressure regulating solenoid valve in accordance with the invention.

Number 5 in FIG. 1 indicates as a whole a solenoid valve for regulating the fuel supply pressure of an internal combustion engine. Solenoid valve 5 comprises a valve body 6 having a supply conduit 7*a* extending axially along a first cylindrical portion 8 of valve body 6; supply conduit 7*a* comprises a calibrated-diameter portion 9, and communicates with the delivery side of a high-pressure fuel supply pump not shown; and cylindrical portion 8 is fitted in fluidtight manner to the body of the pump by means of appropriate seals 10.

Cylindrical portion 8 has a series of radial holes 11 communicating with a drain conduit (not shown) in the pump body. Between supply conduit 7*a* and radial holes 11, there is provided a shutter in the form of a ball 12, which engages a conical seat 13, formed at the end of portion 9, to close conduit 7*a*; solenoid valve 5 comprises an electromagnet having a body 15 to which valve body 6 is fitted in known manner; and the electromagnet controls an armature having a stem 16 sliding inside a hole 17 in body 15 and for controlling ball 12.

The fuel in supply conduit 7*a* must be kept at an operating pressure of at least 1000 bar. Preferably, the selected operating pressure is about 1400 bar; and the inside diameter of conduit 7*a* may advantageously be about 2.5 mm.

According to the invention, supply conduit 7*a* is provided with fuel filtration means, i.e. a filter comprising a cylindrical wall 22 having one end 23 integral with conduit 7*a* Wall 22 comprises a number of openings in the form of circular holes 24, only some of which are shown in FIG. 1 for the sake of clarity, and which are formed using a laser drilling device. After drilling, the other end 26 of wall 22 is closed by an end or bottom wall, formed of a plug or plate 27 inserted into end 26 in known manner.

Wall 22 is less than 1 mm, e.g. 0.5 to 0.8 mm, thick; holes 24 are less than 0.25 mm, e.g. 0.05 to 0.08 mm, in diameter; and the surface of wall 22 is such as to house at least 500 holes 24. Advantageously, the selected hole diameter is about 0.06 mm, and the selected number of holes 24 is about 2000.

So drilled, wall 22 prevents particles of dirt, normally minute metal particles, from infiltrating between conical seat 13 and ball 12, thus preventing sealing problems on solenoid valve 5 which may cause the fuel pressure. in conduit 7*a* to fall so low as to impair operation of the fuel supply system as a whole.

Holes 24, on the other hand, are such as not to cause an excessive fall in fuel pressure along conduit 7*a*, and to avoid hydraulic cavitation erosion phenomena. An excessive fall in pressure, in fact, is prevented by drilled wall 22 having just the right ratio between the length of holes 24 and the total passage section.

Figure 2:
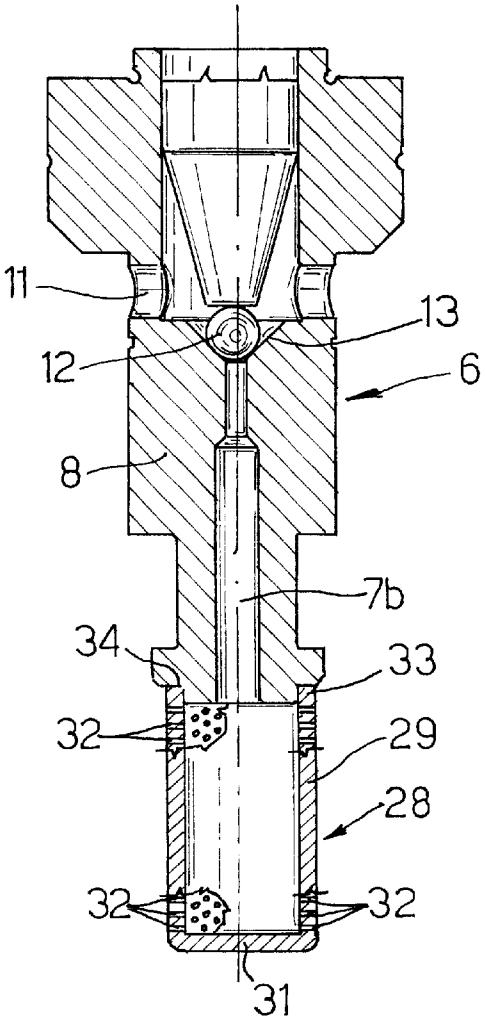
FIG. 2 shows a section of a further embodiment of a regulating solenoid valve in accordance with the invention.

In the FIG. 2 embodiment, the filtration means comprise a cup-shaped body 28 made, for example, of metal; body 28 is separated from the supply conduit 7*b* and has a cylindrical wall 29 integral with a bottom wall 31; with the exception of an end portion 33, wall 29 is drilled with holes 32 substantially similar to holes 24 in the FIG. 1 wall 22; after drilling, body 28 is inserted with end 33 resting on a seat defined by an outer shoulder 34 of conduit 7*b*; and drilled wall 29 has the same filtering effect as wall 22 in FIG. 1.

Figure 4:
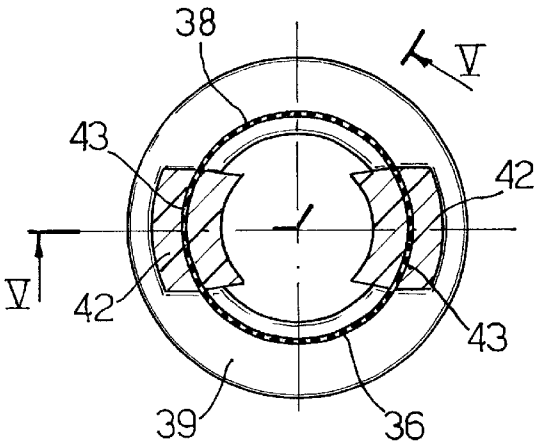
FIG. 4 shows a larger-scale section along line IV—IV in FIG. 3.
Figure 5:
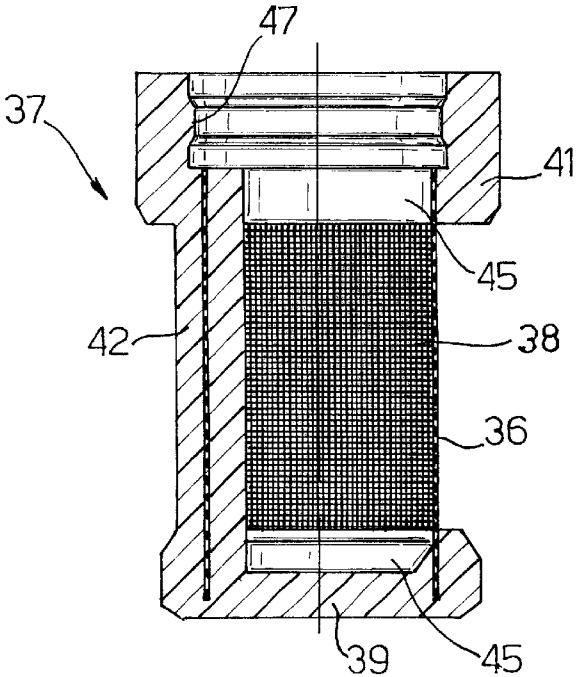
FIG. 5 shows a section along line V—V in FIG. 4.
Figure 3:
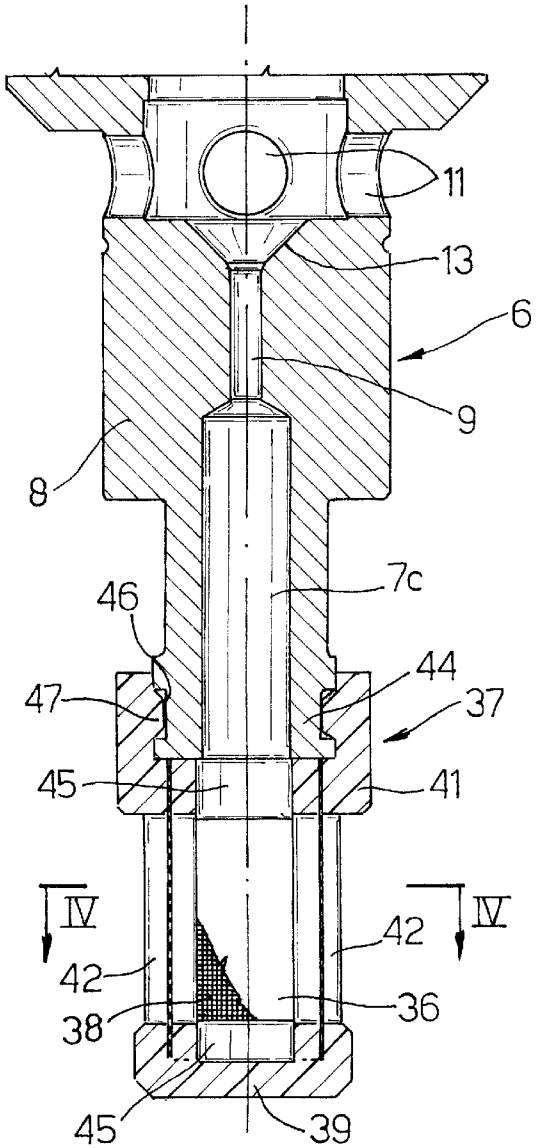
FIG. 3 shows a section of a further embodiment of a solenoid valve in accordance with the invention.

In the FIGS. 3–5 embodiment, the filtration means comprise a cylindrical wall made of netting 36 of wire or other material; and netting 36 is fixed to the conduit 7*c* by a frame 37 for supporting netting 36, and which is made of plastic material molded on to netting 36 as explained clearly below.

Netting 36 is of maximum 1 mm thickness and has meshes 38 of 0.05 to 0.08 mm in width so as to contain about 2000 meshes 38. The thickness of netting 36 is therefore also such as to achieve the right ratio between the length of meshes 38 and the total passage section and so prevent an excessive fall in pressure.

Frame 37 comprises a bottom wall 39 (FIGS. 3 and 4); a ring 41 which fits on to conduit 7*c* of valve body 6; and at least two cylindrical sectors 42 integral with bottom wall 39 and ring 41. More specifically, two diametrically opposite cylindrical sectors 42 are provided. Netting 36 is fixed to two rings 45 made of sheet metal and which are embedded in ring 41 and wall 39 of frame 37, and two cylindrical sectors 43 of netting 36 are embedded in sectors 42 of frame 37.

To fit frame 37 on to conduit 7*c*, one end 44 (FIG. 3) of conduit 7*c* has a groove 46, and ring 41 has a projection 47 which clicks into groove 46. Netting 36 has the same filtering effect as drilled cylindrical walls 22 and 29.

The advantages, as compared with known solenoid valves, of solenoid valve 5 according to the invention will be clear from the foregoing description. On the one hand, filtering walls 22, 29 and 36 prevent sealing problems arising between ball 12 and conical seat 13 without producing an excessive fall in pressure, and, on the other, prevent cavitation erosion phenomena inside conical seat 13.

Clearly, further changes and improvements can be made to the solenoid valve as described herein without, however, departing from the scope of the accompanying claims. For example, the filter may be formed differently or comprise more than one filtering wall located in any position along the supply conduit.

I claim:

1. A solenoid valve for regulating the fuel supply pressure of an internal combustion engine, and which comprises a fuel supply conduit (7*a*, 7*b*, 7*c*) extending axially along a cylindrical portion (8) of a valve body (6), and a shutter (12) controlled by an electromagnet and cooperating with a seat (13) in said conduit (7*a*, 7*b*, 7*c*), and fuel filtration means (22, 24; 29, 31; 36, 38) located in said conduit (7*a*, 7*b*, 7*c*) and comprising a cylindrical wall (22, 29, 36) having a number of openings (24, 32, 38) for preventing particles of dirt from infiltrating between said seat (13) and said shutter (12), without producing an excessive fall in fuel pressure; a thickness of said cylindrical wall (22, 29, 36) being less than 1 mm; and a width of said openings (24, 32, 38) being less than 0.25 mm, said cylindrical wall (22, 29, 36) having one end secured to a first end of said conduit (7*a*, 7*b*, 7*c*) and another end closed by an end wall (17, 31, 39);, said seat (13) being located at a second end of said conduit (7*a*, 7*b*, 7*c*).

2. A solenoid valve as claimed in claim 1, characterized in that said openings (24, 32, 38) are 0.05 to 0.08 mm in width.

3. A solenoid valve as claimed in claim 2, characterized in that said cylindrical wall (22, 29, 36) is 0.5 to 0.8 mm in thickness; said openings being defined by circular holes (24, 32); said holes (24, 32) being formed using a laser drilling device; and said holes (24, 32) being over 500 in number.

4. A solenoid valve as claimed in claim 3, characterized in that the diameter of said circular holes (24, 32) is about 0.06 mm; and said holes (24, 32) being about 2000 in number.

5. A solenoid valve as claimed in claim 1, characterized in that said seat (13) is conical; said shutter comprising a ball (12) cooperating with said conical seat (13); and said second end being provided on a calibrated portion (9) of said conduit (7*a*, 7*b*, 7*c*).

6. A solenoid valve for regulating the fuel supply pressure of an internal combustion engine, comprising a fuel supply conduit, a shutter controlled by an electromagnet and cooperating with a seat in said conduit, and fuel filtration means located in said conduit, said filtration means comprising a cylindrical wall having a number of openings for preventing particles of dirt from infiltrating between said seat and said shutter, without producing an excessive all in fuel pressure; wherein said cylindrical wall is less than 1 mm in thickness and is made of a netting having meshes of 0.05 to 0.08 mm square, said netting being supported by a frame fitting on to said conduit, said netting comprising a bottom wall, a ring fitting on to said conduit, and at least two cylindrical sectors integral with said bottom wall and with said ring, said cylindrical sectors supporting said netting.

7. A solenoid valve as claimed in claim 6, characterized in that said netting (36) is made of metal and has two supporting rings (45); said frame (37) being made of plastic material and being molded on to said netting (36) so tat said supporting rings (45) are embedded in the ring (41) and in the bottom wall (39) of said frame (37), and so tat two sectors (43) of said netting (36) are embedded in the cylindrical sectors (42) of said frame (37).

8. A solenoid valve as claimed in claim 7, characterized in that the ring (41) of said frame (37) comprises an annular projection (47) which clicks into a groove (46) on said conduit (7*c*).

9. A solenoid valve for regulating the fuel supply pressure of an internal combustion engine, comprising a fuel supply conduit, a shutter controlled by an electromagnet and cooperating with a seat in said conduit, and fuel filtration means located in said conduit, said filtration means comprising a cylindrical wall having a number of openings for preventing particles of dirt from infiltrating between said seat and said shutter, without producing an excessive fall in fuel pressure; wherein said cylindrical wall is 0.5 to 0.8 mm in thickness, and wherein said openings are defined by circular holes formed by using a laser drilling device, said circular holes having a diameter of about 0.06 mm and being about 2000 in number, said cylindrical wall having one end integral with one end of said conduit another end of said conduit being closed by a plug inserted inside said other end.

10. A solenoid valve for regulating the fuel supply pressure of an internal combustion engine, comprising a fuel supply conduit, a shutter controlled by an electromagnet and cooperating with a seat in said conduit, and fuel filtration means located in said conduit, said filtration means comprising a cylindrical wall having a number of openings for preventing particles of dirt from infiltrating between sad seat and said shutter, without producing an excessive fall in fuel pressure; wherein said cylindrical wall is 0.5 to 0.8 mm in thickness, and wherein said openings are defined by circular holes formed by using a laser drilling device, said circular holes having a diameter of about 0.06 mm and being about 2000 in number, said cylindrical wall being separate from said conduit and integral with a bottom wall of a cup-shaped body, said cylindrical wall comprising a portion which fits on to a shoulder of said conduit.

11. A solenoid valve for regulating the fuel supply pressure of an internal combustion engine, comprising a fuel supply with a conduit passing through a housing pat a shutter controlled by an electromagnet and cooperating with a seat at one end of said conduit in said housing part and an other end thereof being closed, and fuel filtration means for preventing particles of dirt from infiltrating between said seat and said shutter and located upstream of said seat in said conduit in the housing part, said filtration means comprising a part of the cylindrical wall of said conduit with a thickness of 0.5 to 0.8 mm, wherein circular holes are formed by using a laser drilling device, said circular holes having a diameter of about 0.06 mm and being about 2000 in number, for not producing an excessive fall in the fuel pressure wherein the other end of the conduit being closed by a plug inserted inside said other end.

* * * * *

UNITED STATES PATENT AND TRADEMARK OFFICE

CERTIFICATE OF CORRECTION

PATENT NO. : 6,502,553 B2
DATED : January 7, 2003
INVENTOR(S) : Banzhaf

It is certified that error appears in the above-identified patent and that said Letters Patent is hereby corrected as shown below:

Title page,
Item [30], Foreign Application Priority Data, "T0000A0143" should read -- TO00A0143 --

Signed and Sealed this

Fifteenth Day of July, 2003

JAMES E. ROGAN
*Director of the United States Patent and Trademark Office*